United States Patent [19]

Antonissen

[11] Patent Number: 4,580,475

[45] Date of Patent: Apr. 8, 1986

[54] SLICING MACHINE HAVING MEANS TO CALCULATE THE NUMBER OF SLICES TO BE CUT TO PRODUCE A GROUP OF DESIRED WEIGHT

[75] Inventor: Peter Antonissen, Norfolk, England

[73] Assignee: Thurne Engineering Company Limited, England

[21] Appl. No.: 614,429

[22] Filed: May 29, 1984

[30] Foreign Application Priority Data

May 27, 1983 [GB] United Kingdom ..... 8314765

[51] Int. Cl.[4] ..... B26D 7/30

[52] U.S. Cl. ..... 83/71; 83/73; 83/77; 83/81; 83/278

[58] Field of Search ..... 83/69, 71, 73, 77, 88, 83/81, 82, 278

[56] References Cited

U.S. PATENT DOCUMENTS

| | | | |
|---|---|---|---|
| 3,821,913 | 7/1974 | Bajcar et al. | 83/73 |
| 3,894,457 | 7/1975 | Miller et al. | 83/27 |
| 3,906,823 | 9/1975 | Spooner | 83/73 |
| 3,995,517 | 12/1976 | Smith | 83/73 |
| 4,065,911 | 1/1978 | Fagan | 83/73 |
| 4,178,820 | 12/1979 | Gerber | 83/71 X |
| 4,312,252 | 1/1982 | Duddridge | 83/88 X |
| 4,437,367 | 3/1984 | Hauser | 83/71 X |

*Primary Examiner*—James M. Meister

*Attorney, Agent, or Firm*—Sughrue, Mion, Zinn, Macpeak and Seas

[57] ABSTRACT

A slicing machine comprises a blade 1, feeding mechanism 8, 9, 11, 12 to feed a product 7, typically a food product, towards the blade 1, and a conveyor system 14 downstream of the blade 1 to form groups of slices. The machine also includes a programmed computer 18 to control the feed rate of the feeding mechanism 8, 9, 11, 12 and control the conveyor system 14 to form groups of slices 13. The programmed computer 18 is programmed to calculate the optimum number of slices and thickness of the slices forming each group in dependence upon physical parameters of the product 7 and to control the feed rate of the feeding mechanism 8, 9, 11, 12 and the conveyor system 14 to form the groups so that the slices in each group are of optimum thickness and there are the optimum number of slices in each group.

5 Claims, 2 Drawing Figures

SLICING MACHINE HAVING MEANS TO CALCULATE THE NUMBER OF SLICES TO BE CUT TO PRODUCE A GROUP OF DESIRED WEIGHT

BACKGROUND OF THE INVENTION

This invention relates to slicing machines that are principally used for slicing, food products, particularly for slicing cheese, meat and pressed or moulded meat products.

Such a slicing machine comprises a rotating blade which either has a spiral cutting edge or has a circular cutting edge and is mounted for planetary motion, and means to feed the product towards the blade so that upon each revolution or each gyration of the blade one slice is cut from the face of the product. The means to feed the product may be a continuous conveyor but usually the slicer includes a fixed platform on which the product is placed and a feeding head which engages the rear face of the product and which urges the meat or meat product towards the blade. The feeding head is moved by a hydraulic ram or by a leadscrew driven by a stepping or variable speed electric motor.

A slicing machine is usually required to produce groups of product slices and each group is then packaged separately. This may be achieved by having the slicing machine discharge onto a constant speed conveyor and by interrupting the feed of the product towards the blade for a period of time, each time a predetermined number of slices have been cut from its face. However, more usually, the conveyor downstream from the slicing machine is a jump conveyor. In this case the jump conveyor moves at a first speed whilst the slices to form each group are being cut and then, after the number of slices required for that group have been cut, the jump conveyor moves at a second speed which is considerably faster than the first speed. The jump conveyor then returns to the first speed for the slices to form the next group. In this way the slices are cut at a uniform rate from the product but the increase in speed of the jump conveyor after each group of slices has been cut, results in a series of groups of slices being formed on the jump conveyor.

It is desirable for each group of slices to have a predetermined, required weight and various attempts and proposals have been made in the past for ways to achieve this. The principal difficulty in achieving uniformity results from the nature of the product being sliced. Food products are derived from natural products and are therefore not uniform in density. Their dimensions and hence their cross-sectional area also vary, for example pieces of meat vary with the size and shape of animal from which they have been obtained and even semi-manufactured products such as cheese and meat products formed in a mould, vary in size depending on their water content. In one way that has been proposed previously to overcome these problems slices of uniform thickness are cut from the product and the number of slices in each group is varied to achieve at least the required weight for each group of slices. This technique is rather wasteful and at times, almost a whole slice overweight is included in each group of slices. Equally, some of the other proposals vary the thickness of the slices throughout the slicing operation. Sometimes this method leads to variations in the slice thickness of the different slices in the pack which is particularly noticeable and undesirable from a commercial point of view. In any event, where fixed pack weights are obtained by varying the slice thickness, it is possible for the resulting slices to be too thick or too thin to be commercially acceptable. This is of course particularly true with meat and meat products. Equally, when providing the required pack weight by varying the number of slices there comes a point when the number of slices per pack also varies beyond the commercially desirable limit and thus, none of the existing proposals produce groups of slices that are consistently satisfactory irrespective of variations in the density and cross sectional area of the products being sliced.

SUMMARY OF THE INVENTION

According to this invention a slicing machine comprising a blade, feed means to feed the product towards the blade, and means including a conveyor downstream of the blade to form groups of slices, also includes a programmed computer to control the feed rate of the feed means and arranged to control the means to form groups of slices, the programmed computer being programmed to calculate the optimum number of slices and thickness for the slices forming each group in dependence upon physical parameters of the product currently being sliced, and to control the feed rate of the feed means and the means to form groups so that the slices in each group are of optimum thickness and there are the optimum number of slices in each group.

The programmed computer may be fed with information on the weight of the product per unit length and ways in which this can be derived are described in our co-pending patent application Ser. No. 614,427 filed on the same date as the present application and claiming priority from British patent application Ser. No. 8314762. Alternatively, the information with regard to the physical parameters of the product may simply be obtained by weighing previously cut groups of slices and by then applying a correction to compensate for the difference between the weight of a preceding group of slices and the required pack weight. In both of these cases, a signal is produced which represents the calculated required slice thickness to achieve a desired pack weight with a predetermined number of slices. The computer is programmed to compare this calculated required slice thickness with limiting values corresponding to the maximum and minimum desired slice thicknesses, and if the calculated required slice thickness is between, or equal to, the maximum or minimum desired slice thickness then the computer sets the feed means to provide slices of the calculated required slice thickness and sets the means to form shingled groups to form groups with the predetermined number of slices. However, if the calculated required slice thickness is outside the maximum and minimum desired slice thickness values, the program in the computer is then arranged to increase the predetermined number of slices in each group by one if the calculated required slice thickness is greater than the maximum desired slice thickness and, correspondingly, reduce the predetermined number of slices in each group by one if the calculated required slice thickness is less than the minimum desired slice thickness. The computer is programmed to recalculate the slice thickness required to achieve a desired pack weight with the different number of slices in each group and then once again compare the newly calculated required slice thickness with the desired maximum or minimum slice thickness. Naturally, if the newly calculated required slice thickness is between or equal to the maximum or minimum desired slice thickness the computer then sets the feed means to feed the product at the rate to achieve the newly calculated required slice thickness, and sets the means to form the groups to form groups with the different number of slices in each group. However, if the newly calculated required slice thickness is still not within the desired slice thickness tolerance a further slice is added or, removed from, the number of slices in each group until both the number of slices and the thickness of the slices are within the desired tolerance and then the feed means and the means to form groups of slices are set to these values.

Naturally, the slicing machine also includes input means to input the desired maximum and minimum thickness, the desired maximum and minimum number of slices and the desired pack weight. Of course, these vary for the particular product being sliced at any instant so that, for example, when ham is being sliced, the maximum and minimum desired slice thickness and the number of slices in each pack are different from the maximum and minimum desired slice thickness and and the number of slices for sausage and other meat products. Preferably the programmed computer also includes storage means to store the desired parameters for each of the products that are normally slice by that machine and in this case, the operator simply inputs a word or a code or even presses a single button corresponding to the particular product to be sliced, and then the desired values for that particular product are loaded into the programmed computer automatically.

BRIEF DESCRIPTION OF THE DRAWINGS

A particular example in accordance with this invention will now be described with reference to the accompanying drawings, in which.

DESCRIPTION OF THE PREFERRED EXAMPLE

Figure 1:
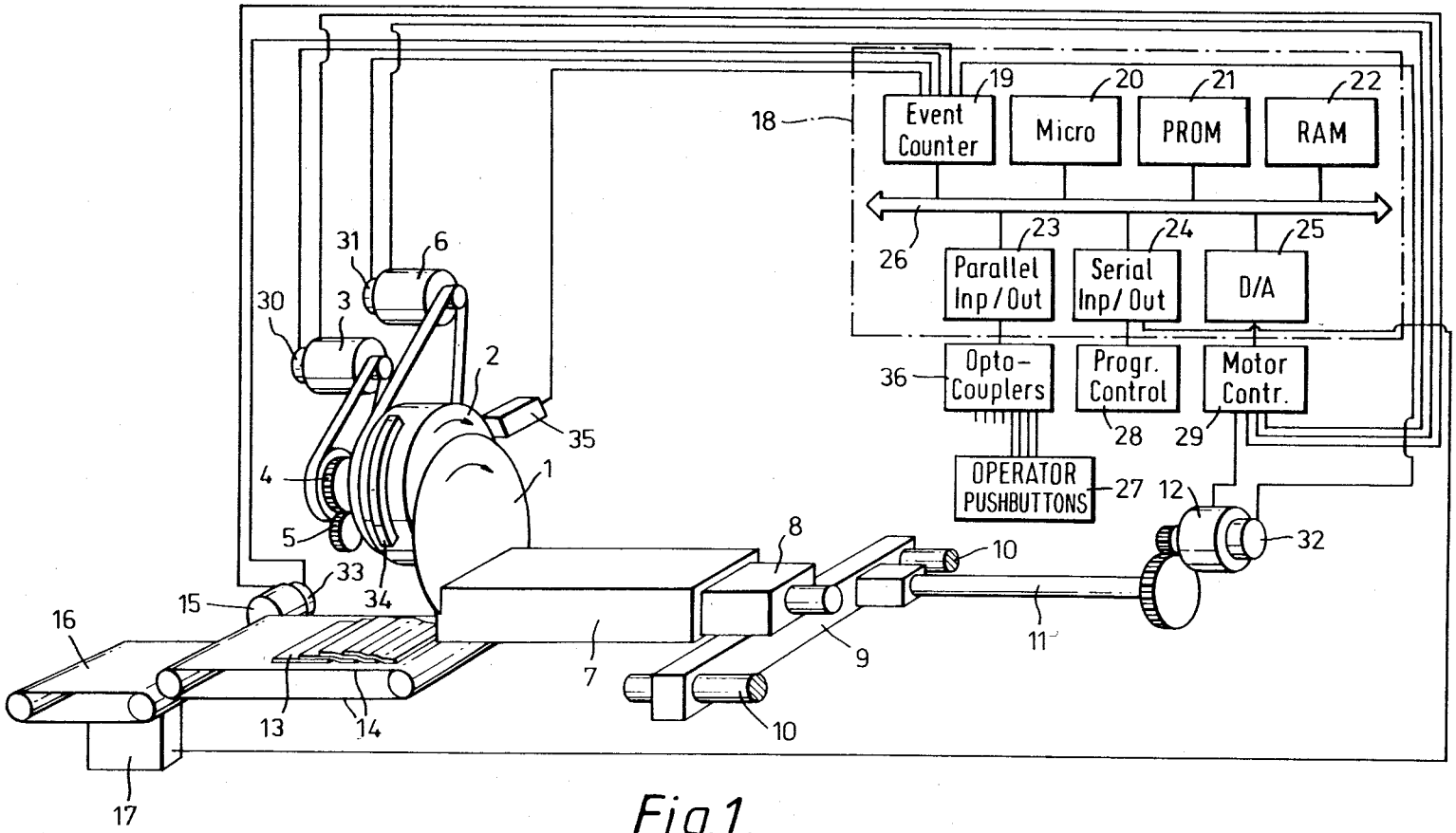
FIG. 1 is a diagrammatic representation of the slicing machine and jump conveyor; and, FIG. 2 is a flow chart for the program loaded into the computer.

The basic mechanical construction of the slicing machine and jump conveyor is conventional and is typically like that known as a "Polyslicer" manufactured by Thurne Engineering Co. Ltd of Norwich, United Kingdom. It comprises a planetary blade 1, journalled in a counter-rotating hub 2. The blade 1 is driven by a motor 3 through pinion gears 4 and 5 and the hub 2 is driven by a motor 6. A block 7 of meat or a meat product is placed on a feed table (not shown) and driven towards the blade 1 by feeding head 8. The feeding head 8 is mounted on a bearer 9 which is carried on a pair of rails 10. The feeding head 8 and bearer 9 are moved backwards and forwards along the rails 10 by a lead screw 11 which is rotated by a motor 12. Slices 13 of meat or meat product cut from the block 7 fall onto a jump conveyor 14 located downstream of the blade and driven by a motor 15. Downstream from the jump conveyor 14 is a conveyor 16 passing over a weigh cell 17. Slices 13 are cut from the face of the block 7 of meat by the blade 1 at a uniform rate. The jump conveyor 14 is moved forward continuously by the motor 15 at a first rate to provide a shingled group of slices as shown in FIG. 1 and then, after completion of the number of slices to form that group, the jump conveyor 14 is moved at a second, much faster rate by the motor 15, to provide a space between the last slice of one group and the first slice 13 of the next group. The groups of slices 13 are then fed from the jump conveyor 14 onto the conveyor 16 and as they pass over the weigh cell 17 their weight is monitored.

Whilst the mechanical arrangement of the slicer is generally conventional, the slicer also includes a computer 18. The computer 18 may be based on type RT1-1260/1262 manufactured by Prolog Corporation of the U.S.A., for example. The computer 18 typically includes an event counter 19, a microprocessor 20, a programmable read only memory 21, a random access memory 22, parallel input/output ports 23 serial input-/output ports 24, and digital to analogue convertor unit 25 all connected together by a bus 26. The computer 18 is also connected to operator control buttons 27, program control 28 and a motor controller 29. The motor controller 29 controls the operation of the motors 3, 6, 12 and 15 and these include encoders 30, 31, 32 and 33 respectively the outputs of which are fed into the computer 18. The hub 2 includes a cam 34 which cooperates with a proximity switch 35 to provide an output representative of the position of the hub 2 and hence of the blade 1 around its orbit. FIG. 1 shows the encoders 30, 31, 32 and 33, and the proximity switch 35 being directly linked to the event counter 19 for simplicity, in practice these are coupled through an opto-coupling unit 36 and the ports 23. The computer 18 controls the operation of the motors 3, 6, 12 and 15, and hence control the peripheral speed of the blade 1, the rate of rotation of the hub 2 and hence the rate at which the slices 13 are cut from the block 7, the rate of movement of the block 7 towards the blade 1 and hence the thickness T of each slice 13, and also controls the operation of the jump conveyor 14 and hence the number of slices N in each group. The computer also controls the timing of the actuation of the motor 12 and hence enable the machine to operate by moving the block of meat 7 only when the switch 35 indicates that the blade 1 is away from the block 7.

The required presentation of a product naturally varies with the nature of the product and thus, when the product is for example ham, the required slice thickness, the number of slices in each pack, and its cutting speed are different from those of sausage. Usually a stored library of information is set up in the memories 21 and 22 giving all the information required to enable the slicing machine to produce packs with the required characteristics. The operator then selects a particular set of instructions, for example those for ham, by simply operating a single push button 27 or entering a code representing the product to be sliced. Alternatively the operator can manually enter via the push buttons 27 each of the above parameters.

The block of meat 7, or other product to be sliced is placed on the slicing machine and the machine started. The computer 18 controls the operation of the motors 3 and 6 to set the peripheral speed of the blade 1 and the frequency with which the slices are to be cut and also controls the operation of the motor 12 to move the block 7 towards the blade 1. The computer 18 also controls the operation of a jump conveyor 14 by controlling the motor 15 to cause the motor 15 to increase its speed after the even counter 19 has received a predetermined number of pulses from the proximity switch 35 corresponding to the number of slices which have been cut from the product 7.

At the start of each block 7 the slicing machine is arranged simply to provide slices with the required thickness and with the required number of slices in each pack. However, as soon as the first group to be cut reaches the weigh cell 17 an indication of their weight is fed to the computer 18 so that it can be compared with the required weight and corrections made to the feed of meat or meat product towards the blade to take account of any difference between the measured weight and the required weight.

Figure 2:
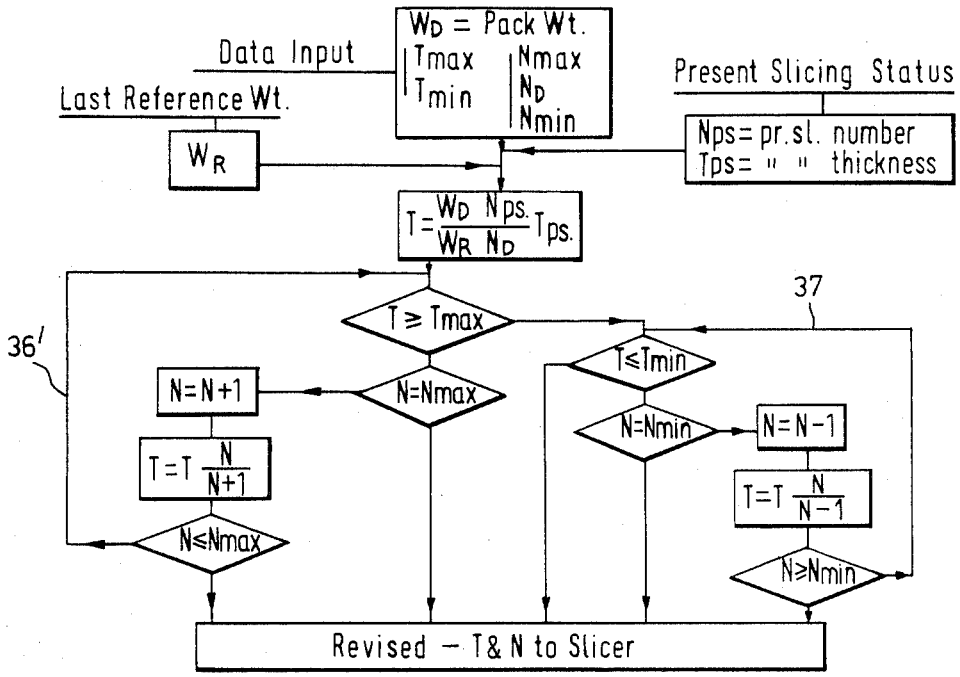

The flow chart of the comparison performed by the computer 18 is illustrated in FIG. 2. Firstly the computer performs a calculation to determine the required thickness T that subsequent slices should have to take account of the difference between the weight $W_R$ of the group of slices as determined by the load cell 17 and the desired weight $W_D$ using the following equation:

$$T = \frac{W_D N_{ps}}{W_R N_D} T_{ps}$$

Where $N_{ps}$ is the number of slices currently forming each group $T_{ps}$ is the thickness of the slices that are currently being cut and $N_D$ is the desired number of slices in each pack.

This newly calculated value for T is then compared with the maximum thickness value, $T_{max}$ that has been entered. Assuming that T is less than or equal to $T_{max}$ the value of T is then compared with the minimum required slice thickness $T_{min}$. Assuming that the revised thickness T is inbetween $T_{max}$ and $T_{min}$ the revised thickness T is simply used as the parameter to control the speed of the motor 12 via the motor controller 29 to drive the feeding head 8 at a speed to give slices of the calculated required thickness. However, if the calculated required thickness T is greater than $T_{max}$ the computer then checks to see whether the current number of slices in each group $N_{ps}$ is equal to the maximum required number of slices in each group $N_{max}$. Assuming that it is not equal to $N_{max}$ then the computer increases the slice count by one and derives a revised slice thickness T which takes account of the change in the number of slices. The computer then determines whether the new number of slices in the group is less than or equal to the maximum number $N_{max}$ and, if it is, simply set the speed of the motor 12 to provide slices of the revised slice thickness. However, if the number of slices in the pack has still not reached the maximum number $N_{max}$, the revised slice thickness T is returned via a loop 36 and it is once more checked to see whether the revised thickness is greater than, or equal to $T_{max}$. Naturally, if it is it follows round the same path described immediately above and has a further slice added to the number of slices in that group, and so on until the number of slices reaches $N_{max}$.

If, in contrast to this situation, the calculated slice thickness T is less than or equal to the minimum slice thickness $T_{min}$, the computer then determines whether the number of slices in the group N is equal to the required minimum $N_{min}$. If so, the revised slice thickness T is used to set the speed of the motor 12 and hence the feed rate of the block of meat 7 to provide slices with the calculated required slice thickness. However, if there are more than the required minimum number of slices in the pack one slice is removed from the number currently requested in each pack and then the slice thickness required is recalculated. After this is done again it is determined whether the new number of slices in the pack is less than the minimum number of slices. If so the revised setting for the thickness of each slice is used to control the speed of the motor 12 and hence the feed rate of the block of meat 7. If it is not the minimum number then the revised slice thickness T is returned via loop 37 to check to see if it is still less than the required minimum thickness for each slice. If so, then a further slice is removed from the number of slices in each pack by a similar process. Naturally this can be repeated until the minimum number of slices in each pack is obtained.

Usually the computer is arranged to statistically sample and weight the output from the weigh cell 17 so that some account is taken not only of the weight of the pack which is currently on the weight cell 17 but also of the packs that have been weighed previously. For example it is convenient if all of the difference in weight between the pack currently on the weigh cell 17 is taken into account, half the difference in weight between the preceding pack and the required weight is taken into account, and a quarter of the difference in weight between the pack in front of the preceding pack and the required weight is taken into account, and so on. Thus, the weight signal $W_R$ which has been referred to earlier may not just be the strict weight recorded by the weigh cell 17 but, may be one that has been statistically weighted.

I claim:

1. In a slicing machine comprising a blade, feed means to feed a product towards the blade and grouping means including a conveyor downstream of said blade to form groups of slices, the improvement wherein said machine also includes a programmed computer arranged to control said feed means and said grouping means, said programmed computer being programmed to calculate before slicing each group both the optimum number of slices and optimum thickness of said slices forming each group in dependence upon physical parameters of said product currently being sliced, and to control said feed means and said grouping means, so that all of said slices in each said group are of equal and said optimum thickness, that all of said slices in each said group are sliced without interruption, and that there are said optimum number of slices in each said group.

2. The slicing machine of claim 1, wherein said computer initially calculates the slice thickness required to achieve a desired pack weight with a predetermined number of slices taking account of said physical parameters of said product, and then compares said calculated required slice thickness with limiting values corresponding to maximum and minimum desired slice thicknesses; if said calculated required slice thickness is between, or equal to, said maximum and minimum desired slice thickness then said computer sets said feed means to provide slices of said calculated required slice thickness and sets said grouping means to form groups with said predetermined number of slices, but if said calculated required slice thickness is outside said maximum and minimum desired slice thickness values, said computer is arranged to increase said predetermined number of slices by one when said calculated required slice thickness is greater than said maximum desired slice thickness and, correspondingly, reduce said predetermined number of slices by one when said calculated required slice thickness is less than said minimum desired slice thickness.

3. The slicing machine of claim 2, wherein after said increase or reduction of said predetermined number of slices by one, said computer recalculates the slice thickness required to achieve a desired pack weight with said different number of slices and then, compares said recalculated required slice thickness with said desired maximum or minimum slice thickness; if the re-calculated required slice thickness is between or equal to the maximum and minimum desired slice thickness said computer sets said feed means to provide slices of the re-calculated required slice thickness, and sets said grouping means to form groups with said different number of slices.

4. The slicing machine of claim 3, wherein if said re-calculated required slice thickness is still not between or equal to said maximum and minimum desired slice thickness said computer adds, or removes, a further slice to the number of slices to be included in each group until both said number of slices and said thickness of said slices are within said maximum and minimum values and, only then sets said feed means and said grouping means to these values.

5. The slicing machine of claim 2, wherein said programmed computer includes storage means to store values corresponding to said desired maximum and minimum thickness, said desired maximum and minimum number of slices and said desired pack weight, for a number of different products; and said slicing machine includes manually operable means to select said values for a particular product to be sliced, and upon their selection said desired values for that particular product being loaded into said programmed computer.

* * * * *